US009334026B1

(12) United States Patent
Smith

(10) Patent No.: US 9,334,026 B1
(45) Date of Patent: May 10, 2016

(54) HYDROPLANING NAVIGATION BUOYS

(71) Applicant: Gregory L. Smith, Hoxie, AR (US)

(72) Inventor: Gregory L. Smith, Hoxie, AR (US)

( * ) Notice: Subject to any disclaimer, the term of this patent is extended or adjusted under 35 U.S.C. 154(b) by 0 days.

(21) Appl. No.: 14/332,803

(22) Filed: Jul. 16, 2014

(51) Int. Cl.
*B63B 22/16* (2006.01)
*B63B 22/20* (2006.01)

(52) U.S. Cl.
CPC ..... *B63B 22/16* (2013.01); *B63B 22/20* (2013.01); *B63B 2201/12* (2013.01); *B63B 2207/00* (2013.01)

(58) Field of Classification Search
CPC ..... B63B 22/16; B63B 22/20
USPC ..... 441/6, 20
See application file for complete search history.

(56) References Cited

U.S. PATENT DOCUMENTS

| | | | | |
|---|---|---|---|---|
| 1,067,113 | A | 7/1913 | Heyn | |
| 3,295,153 | A * | 1/1967 | Dessau | B63B 21/50 114/293 |
| 3,953,905 | A | 5/1976 | Paitson | |
| 4,896,620 | A | 1/1990 | Jones | |
| 5,902,163 | A | 5/1999 | Baruzzi et al. | |

* cited by examiner

*Primary Examiner* — Stephen Avila
(74) *Attorney, Agent, or Firm* — R. Keith Harrison

(57) ABSTRACT

Hydroplaning navigation buoys may include a buoyant buoy body having an elongated water submersible body segment, a buoy rudder carried by the water submersible body segment and a protruding body segment extending from the water submersible body segment in angular relationship thereto.

19 Claims, 8 Drawing Sheets

HYDROPLANING NAVIGATION BUOYS

FIELD

Illustrative embodiments of the disclosure generally relate to navigation buoys. More particularly, illustrative embodiments of the disclosure relate to hydroplaning navigation buoys which are characterized by features creating hydrodynamic lift thereby augmenting displacement buoyancy and achieving enhanced stability and visibility in water having fast current.

BACKGROUND

The background description provided herein is solely for the purpose of generally presenting the context of the illustrative embodiments of the disclosure. Aspects of the background description are neither expressly nor impliedly admitted as prior art against the claimed subject matter.

Navigation buoys are typically used to aid marine navigation and mark hazards on rivers and other water bodies. Current speeds in navigable waterways are known to vary from 0 MPH to approximately 9 MPH. Conventional navigation buoys have limitations which render the buoys ineffective under certain conditions. For example, when the current speed of the water body in which the buoys are deployed exceeds approximately 4.5 mph, conventional buoys are prone to submerge and/or become unstable, inclining at various angles. Consequently, there are some locations in which the buoys are needed but not placed since the buoys cannot be kept on station and visible above the surface. As current speed increases, the buoys may become submerged, rendering them more susceptible to being run over by passing barges, boats and other vessels and potentially causing damage to the vessels or to the buoys themselves. Even if not submerged, when the buoy is so inclined away from an approaching vessel, the buoy does not effectively reflect radar waves and is thus rendered less visible on radar and by sight. This problem may be compounded by drift catching on the buoys, creating more drag and submerging or dragging the buoys off station. Accordingly, approximately 50% of buoys in the inland navigation system presently require annual replacement. In addition to the costs of replacement, there are transportation, storage, retrieval and deployment costs, resulting in large annual expenditures by the Coast Guard. These drawbacks also contribute to vessel accidents and resulting costs to the maritime industry due to the improper marking of hazards to navigation which result from the inherent design limitations of the conventional buoys.

Accordingly, in water having fast current speeds, there is a need for hydroplaning navigation buoys which are characterized by features creating hydrodynamic lift thereby augmenting displacement buoyancy and achieving enhanced stability and visibility.

SUMMARY

Illustrative embodiments of the disclosure are generally directed to hydroplaning navigation buoys which are characterized by features creating hydrodynamic lift thereby augmenting displacement buoyancy and achieving enhanced stability and visibility in water having fast current. The hydroplaning navigation buoys may include a buoyant buoy body having an elongated water submersible body segment, a buoy rudder carried by the water submersible body segment and a protruding body segment extending from the water submersible body segment in angular relationship thereto.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "front", "side" and "rear" as used herein are intended to be descriptive for exemplary use of some illustrative embodiments of the disclosure and are not to be construed in a limiting sense.

Figure 8:
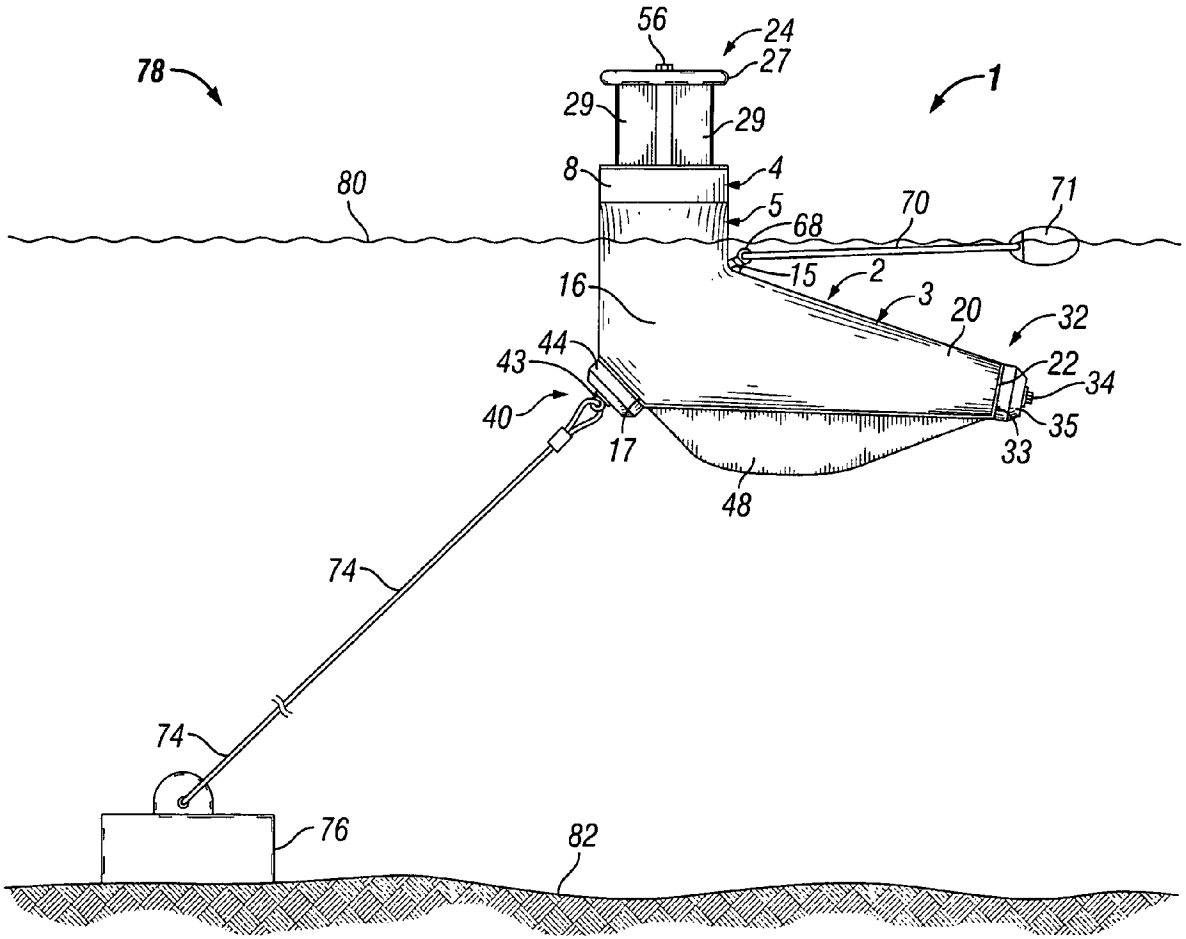
FIG. 8 is a side view of an illustrative hydroplaning navigation buoy, deployed on a water body and anchored to the bottom of the water body in typical application of the buoy.
Figure 9:
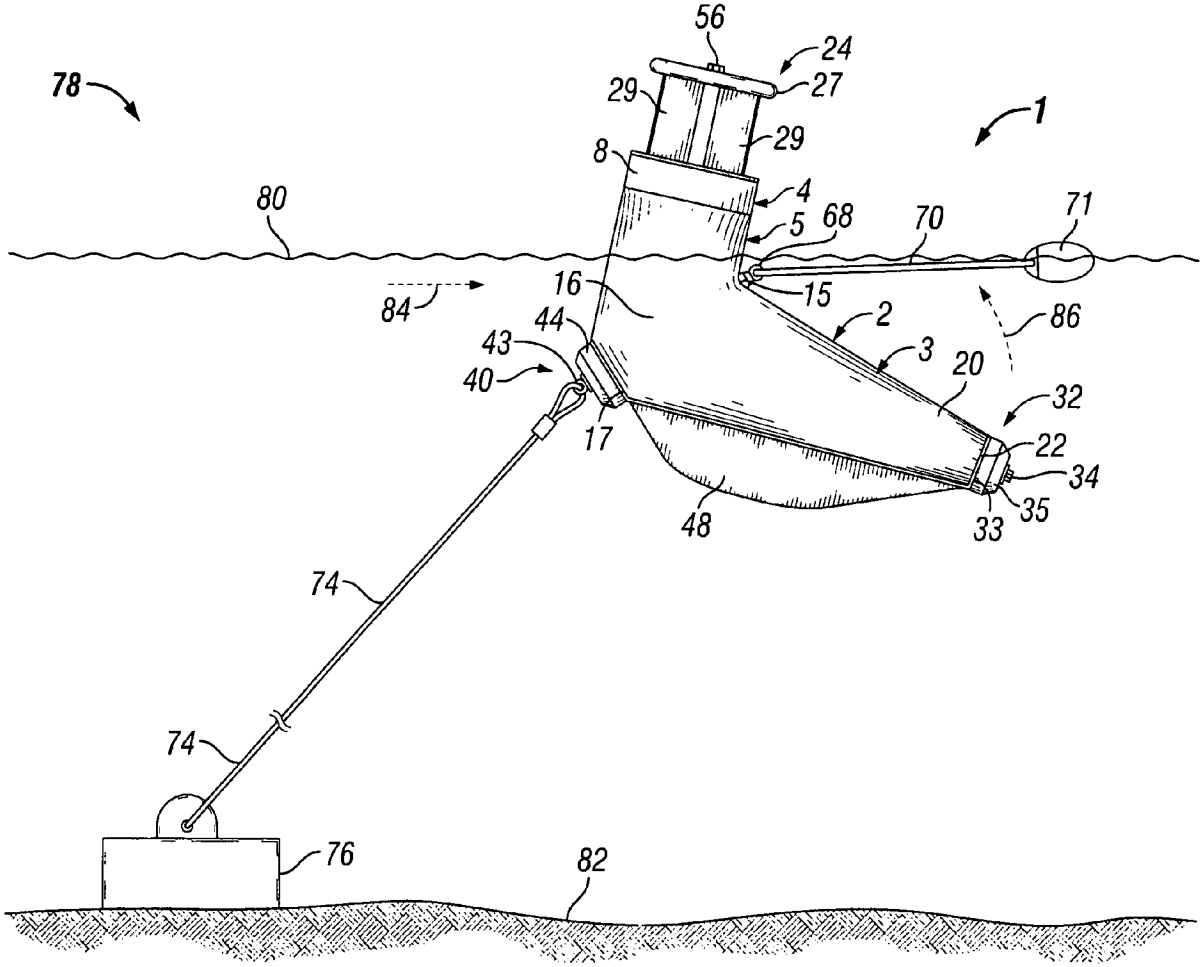
FIG. 9 is a side view of the illustrative anchored hydroplaning navigation buoy, more particularly illustrating positional stability and visibility of the buoy above the waterline of the water body under fast current conditions in typical application of the buoy.

Referring initially to FIGS. 8 and 9 of the drawings, an illustrative embodiment of the hydroplaning navigation buoy is generally indicated by reference numeral 1. As will be hereinafter described, in typical application, the hydroplaning navigation buoy 1 is deployed on a water body 78 such as a navigable river to aid marine navigation and mark hazards on the water body 78. The hydroplaning navigation buoy 1 is characterized by high positional stability in fast or strong current 84 (FIG. 9) and high visibility to operators of marine vessels and on radar.

Figure 1:
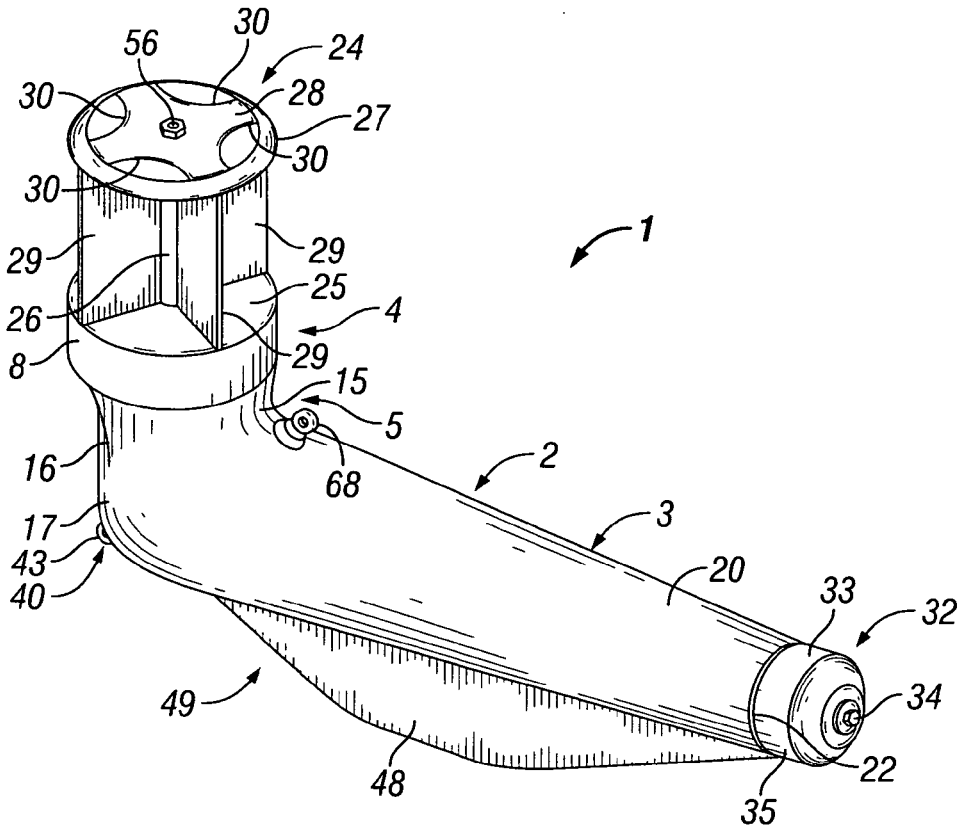
FIG. 1 is a rear perspective view of an illustrative embodiment of the hydroplaning navigation buoy.
Figure 2:
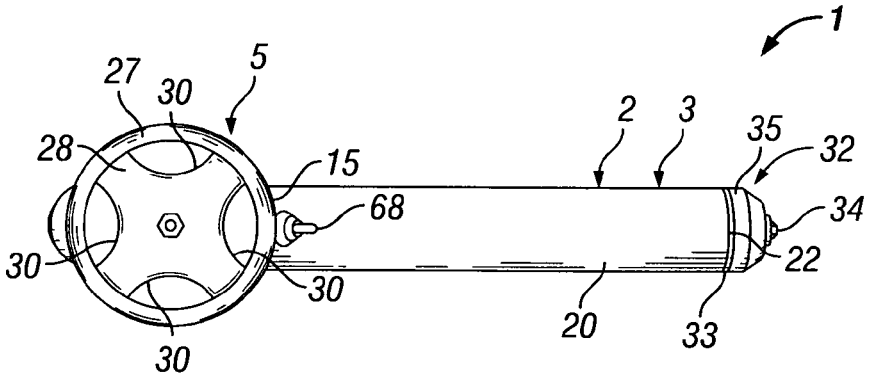
FIG. 2 is a top view of an illustrative hydroplaning navigation buoy.
Figure 3:
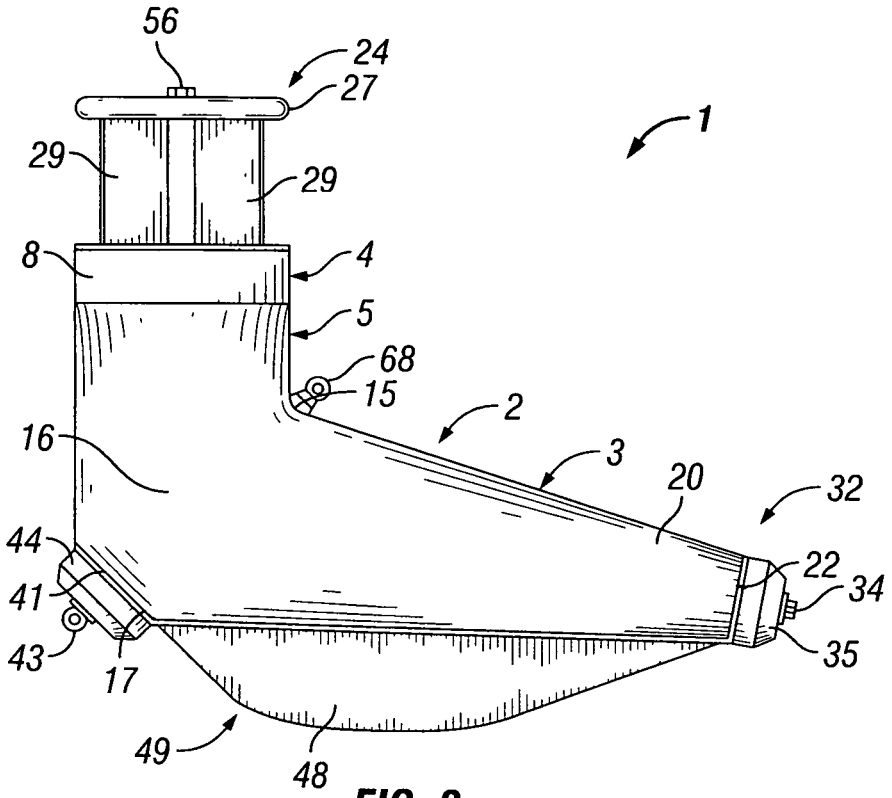
FIG. 3 is a side view of an illustrative hydroplaning navigation buoy.
Figure 4:
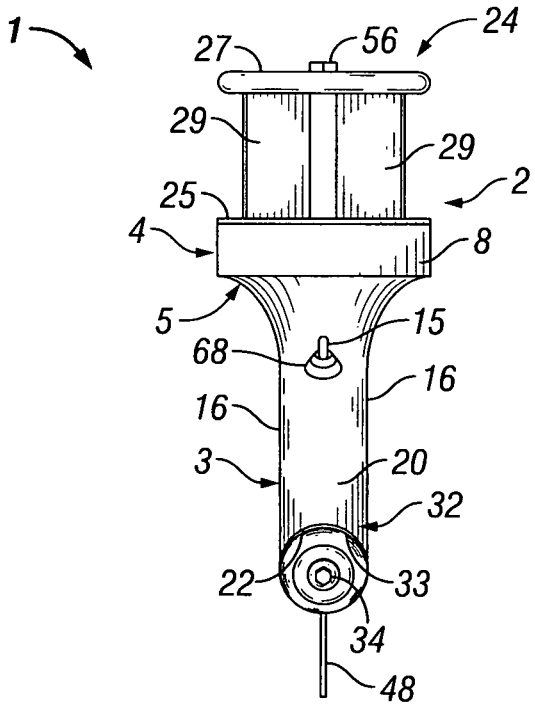
FIG. 4 is a rear view of an illustrative hydroplaning navigation buoy.
Figure 5:
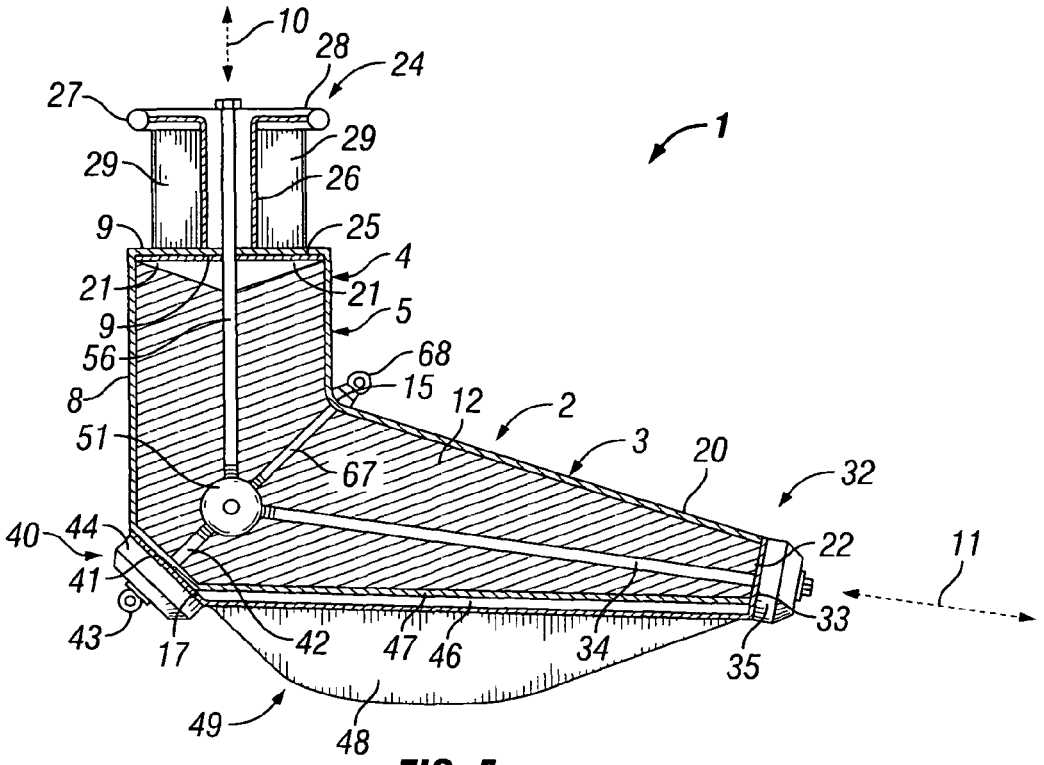
FIG. 5 is a longitudinal sectional view of an illustrative hydroplaning navigation buoy.

Referring next to FIGS. 1-9 of the drawings, the hydroplaning navigation buoy 1 includes a water-buoyant buoy body 2. The buoy body 2 may be generally "L"-shaped and includes an elongated water submersible body segment 3. An elongated buoy rudder 48 may extend downwardly from the water submersible body segment 3. A protruding body segment 4 extends from the water submersible body segment 3. As illustrated in FIG. 5, the protruding body segment 4 may have a first axis 10 which is disposed in angular relationship to a second axis 11 of the submersible body segment 3. In some embodiments, the first axis 10 may be disposed in generally perpendicular relationship to the second axis 11. In other embodiments, the first axis 10 may be disposed at an obtuse angle relative to the second axis 11. A curved connecting portion 5 may connect the protruding body segment 4 to the submersible body segment 3.

As illustrated in FIG. 5, the submersible body segment 3 of the buoy body 2 may include a submersible body segment wall 20. The submersible body segment wall 20 may be generally elliptical and may gradually taper from the connecting portion 5 to a cylindrical shape at a rear submersible segment end 22 of the submersible body segment 3. The connecting portion 5 may have a rear connecting portion wall 15, a front connecting portion wall 17 and a pair of side connecting portion walls 16 (FIG. 4) which extend upwardly from the submersible body segment wall 20 of the submersible body segment 3 to the protruding body segment 4. In some embodiments, the side connecting portion walls 16 may taper inwardly from the protruding body segment 4 to the submersible body segment 3, as illustrated in FIG. 4. The protruding body segment 4 of the buoy body 2 may include a protruding body segment wall 8 which extends from the rear connecting portion wall 15, the side connecting portion walls 16 and the front connecting portion wall 17 of the connecting portion 5. In some embodiments, the protruding body segment wall 8 of the protruding body segment 4 may be generally cylindrical. The protruding body segment wall 8 terminates at a protruding body segment top wall 9. The protruding body segment top wall 9 may have recesses (not illustrated) for receiving reflector indexing plate(s) 21 (FIG. 5) and a lower end of an assembly tube 26 for purposes which will be hereinafter described.

In some embodiments, the submersible body segment 3, the protruding body segment 4 and the connecting portion 5 of the buoy body 2 may be fabricated of a non-buoyant material such as metal, for example and without limitation. Accordingly, as further illustrated in FIG. 5, in some embodiments, a buoyant material 12 such as foam, for example and without limitation, may substantially fill the buoy body 2 to impart water buoyancy thereto. In other embodiments, the buoy body 2 may be (entirely) fabricated of foam or other buoyant material and may be a solid lightweight buoyant material with a plastic or densified skin.

In some embodiments, a buoy rudder assembly 49 may be attached to the submersible body segment 3 of the buoy body 2 according to any suitable technique which is known by those skilled in the art. As illustrated in FIG. 5, in some embodiments, the buoy rudder assembly 49 may be comprised of a buoy rudder 48 and a rudder indexing brace 46 which is inserted in a companion brace slot 47 shaped in an undersurface of the submersible body segment 3. The buoy rudder assembly 49 may also include a rear ballast base plate 33 which is provided adjacent to the rear submersible segment end 22 of the submersible body segment 3. The buoy rudder assembly 49 may further include a front ballast base plate 41 which is provided adjacent to the front connecting portion wall 17 of the connecting portion 3. The buoy rudder 48 and corresponding buoy rudder assembly 49 may extend substantially the entire length of the submersible body segment 3 from the front connecting portion wall 17 of the connecting portion 5 to the rear submersible segment end 22 of the submersible body segment 3.

At least one ballast assembly may be provided on the buoy body 2. In some embodiments, a rear ballast assembly 32 and a front ballast assembly 40 may be provided on the buoy body 2. The rear ballast assembly 32 may include at least one rear ballast weight 35 detachably secured to the rear ballast base plate 33 of the buoy rudder assembly 49 according to the knowledge of those skilled in the art. In some embodiments, each rear ballast weight 35 may be generally disc-shaped. A rear ballast weight bolt 34 may be extended through a bolt opening (not illustrated) in the rear ballast weight 35, then through a bolt opening (not illustrated) in the rear ballast base plate 33 of the buoy rudder assembly 49, then through the submersible body segment 3 and threaded into a frame hub 51 (hereinafter described in more detail) to secure the rear ballast weight 35 against the rear ballast base plate 33 of the buoy rudder assembly 49 and the rear ballast base plate 33 against the rear submersible segment end 22. A selected number of the rear ballast weights 35 may be secured in the rear ballast assembly 32 to impart selected buoyancy to the rear portion of the buoy body 2.

Figure 7:
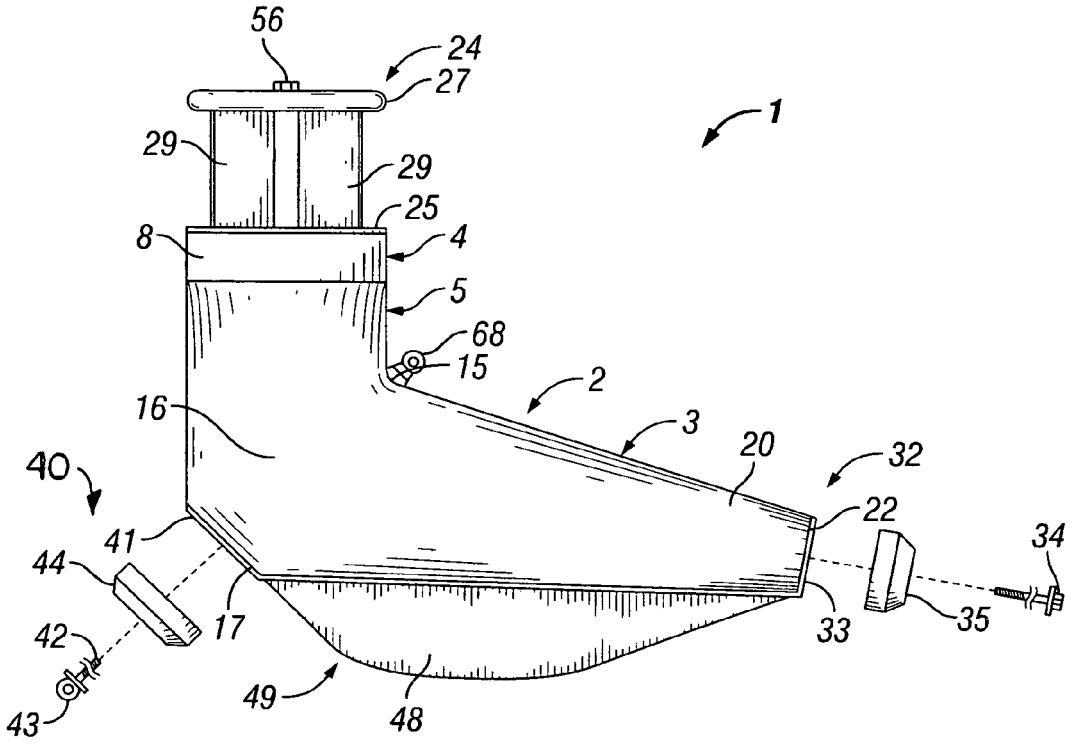
FIG. 7 is an exploded side view of an illustrative hydroplaning navigation buoy, more particularly illustrating typical attachment of front and rear ballast assemblies, respectively, to the buoy.

As further illustrated in FIG. 7, the front ballast assembly 40 may include at least one front ballast weight 44 which may be generally disc-shaped detachably secured to the front ballast base plate 41 of the buoy rudder assembly 49 according to the knowledge of those skilled in the art. In some embodiments, a front ballast weight bolt 42 may be extended through a bolt opening (not illustrated) in the front ballast weight 44 and through a bolt opening (not illustrated) in the front ballast base plate 41, through the front connecting portion wall 17 and threaded into the frame hub 51 (hereinafter described in more detail) to secure the front ballast weight 44 against the front ballast base plate 41 and the front connecting portion wall 17. A selected number of the front ballast weights 44 may be secured in the front ballast assembly 40 to impart selected buoyancy to the front portion of the buoy body 2. An anchor attachment hook 43 may be provided on the front ballast weight bolt 42 for purposes which will be hereinafter described.

Figure 6:
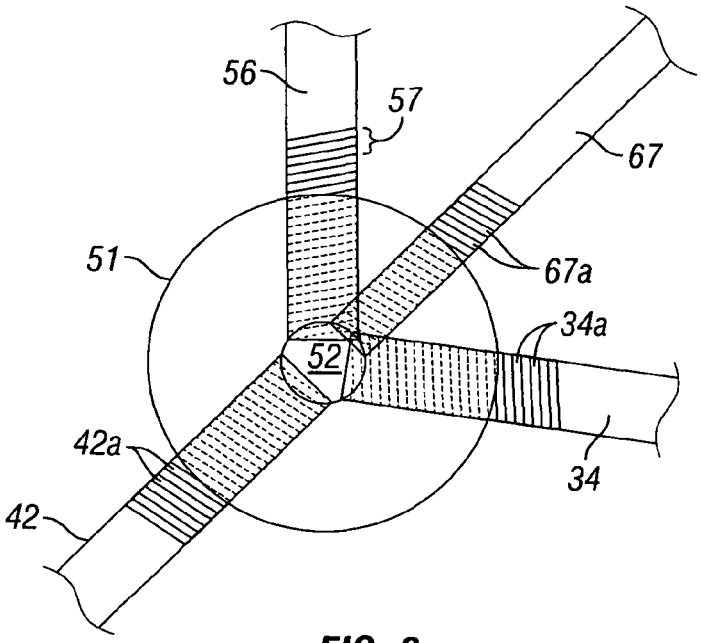
FIG. 6 is an enlarged sectional view of a portion of a typical buoy frame hub according to an illustrative hydroplaning navigation buoy.

As illustrated in FIGS. 5 and 6, in some embodiments, a frame hub 51 may be provided in the buoy body 2 for assembling purposes. As illustrated in FIG. 6, the frame hub 51 may be cylindrical in shape with a hollow center 52 and interiorly threaded hub openings in the outer circumference (not illustrated) for threaded connection of the rear ballast weight bolt 34, the front ballast weight bolt 42, a reflector assembly retaining bolt 56 which will be hereinafter described, and a tagline bolt 67 which will also be hereinafter described. A first end of a reflector assembly retaining bolt 56 may have threads 57 (FIG. 6) which engage a corresponding interiorly-threaded hub opening (not illustrated) in the frame hub 51. The reflector assembly retaining bolt 56 may extend from the frame hub 51 through the protruding body segment 4 of the buoy body 2 and then through an assembly tube 26, respectively, of a radar reflector assembly 24 which may be provided on the protruding body segment 4 and will be hereinafter described.

The rear ballast weight bolt 34 may further include a first end with threads 34*a* (FIG. 6) which engage a corresponding interiorly-threaded hub opening (not illustrated) in the frame hub 51. The rear ballast weight bolt 34 may extend from the frame hub 51 through the submersible body segment 3 of the buoy body 2, through the rear submersible segment end 22, through the rear ballast base plate 33 of the buoy rudder assembly 49, through the rear ballast weight 35 of the rear ballast assembly 32 and terminating on the outside thereof.

The front ballast weight bolt 42 may have a first end with threads 42*a* (FIG. 6) which engage a corresponding interiorly-threaded hub opening (not illustrated) in the frame hub 51. The front ballast weight bolt 42 may extend from the frame hub 51 through a front portion of the connecting portion 5, through the connecting portion wall 17, through the front ballast base plate 41 of the buoy rudder assembly 49, and through the front ballast weight 44 of the front ballast assembly 40 and terminate at the anchor attachment hook 43.

The tagline bolt 67 may have a first end with threads 67*a* (FIG. 6) which engage a corresponding interiorly-threaded hub opening (not illustrated) in the frame hub 51. The tagline bolt 67 may extend from the frame hub 51 through a rear portion of the connecting portion 5, through an opening (not illustrated) in the rear connecting portion wall 15 and terminate at a tagline connector hook 68. The tagline connector hook 68 may be provided on the tagline bolt 67 for purposes which will be hereinafter described.

A radar reflector assembly 24 may be provided on the protruding body segment 4 of the buoy body 2. The radar reflector assembly 24 may include an assembly base plate 25 which is provided adjacent to the protruding body segment top wall 9 of the protruding body segment 4. Extending downwardly from the approximate center of the assembly base plate 25 and into a recess (not illustrated) in the protruding body segment top wall 9 may be an assembly tube 26. Also extending downwardly from the assembly base plate 25 and radiating out from the assembly tube 26 into corresponding recesses (not illustrated) in the upper end wall 9 may be at least one reflector indexing brace 21 (FIG. 5) for the purpose of preventing rotation of the radar reflector assembly 24. The reflector indexing brace(s) 21 and corresponding recesses (not illustrated) may be triangular in shape. The assembly tube 26 may extend upwardly from the lower edge of the reflector indexing brace 21 through the assembly base plate 25 to an assembly ring support frame 28. The assembly ring support frame 28 may extend outwardly from the assembly tube 26 to an assembly ring 27. Multiple frame notches 30 (FIGS. 1 and 2) may be provided in the assembly ring support frame 28. Multiple spaced-apart radar reflective plates 29 may extend outwardly from the assembly tube 26 between the assembly base plate 25 and the assembly ring support frame 28 for purposes which will be hereinafter described. In some embodiments, each of the radar reflective plates 29 may be generally rectangular and may be disposed at about 90 degrees with respect to each other and at about a 45-degree angle with respect to a vertical centerline of the deployed attitude of the buoy body 2 in current 84 (FIGS. 8 and 9) in application of the hydroplaning navigation buoy 1, which will be hereinafter described. Color-coded retro-reflective tape (not illustrated) may be applied to the radar reflective plates 29 for enhanced visibility as is known by those skilled in the art. A reflector assembly retaining bolt 56 may be extended through a bolt opening (not illustrated) in the assembly ring support frame 28, through the assembly tube 26, through the protruding body segment top wall 9, through the protruding body segment 4 and threaded into the frame hub 51. Accordingly, in some embodiments, the reflector assembly retaining bolt 56 may facilitate detachable attachment of the radar reflector assembly 24 to the protruding body segment 4 of the buoy body 2.

As illustrated in FIG. 3, a tagline connector hook 68 may be provided on the buoy body 2. In some embodiments, the tagline connector hook 68 may be provided on the tagline bolt 67 (FIG. 5) at the rear connecting portion wall 15 of the connecting portion 5. In other embodiments, the tagline connector hook 68 may be provided at any other suitable location on the buoy body 2. As illustrated in FIGS. 8 and 9, in typical application of the hydroplaning navigation buoy 1, which will be hereinafter described, a tagline 70 may be tied or otherwise attached to the tagline connector hook 68. A tagline buoy 71 may be attached to the tagline 70. Accordingly, the tagline buoy 71 indicates the direction of current 84 (FIG. 9) in a river or other water body 78 in which the hydroplaning navigation buoy 1 is deployed, typically in the conventional manner. Color-coded retro-reflective tape (not illustrated) may be applied to the tagline buoy 71 to enhance visibility of the tagline buoy 71 at night.

As illustrated in FIGS. 8 and 9, in typical application, the hydroplaning navigation buoy 1 is deployed on a water body 78 such as a navigable river to aid marine navigation and mark hazards on the water body 78. Accordingly, the rear ballast assembly 32 may be assembled with a selected number of the rear ballast weights 35 and the front ballast assembly 40 may be assembled with a selected number of the front ballast weights 44. The rear ballast assembly 32 and the front ballast assembly 40 may impart stability to the buoy body 2 as well as adjustment of the depth of the buoy body 2 in the water body 78 and the trim and attitude of the buoy body 2 in the current 84. An anchor line 74 may attach the anchor attachment hook 43 on the front ballast assembly 40 to a submerged anchor weight 76 on the bottom 82 of the water body 78. The tagline 70 to which the tagline buoy 71 is attached may be tied or otherwise attached to the tagline connector hook 68 on the buoy body 2. The buoy body 2 floats on the water body 78 with the submersible body segment 3 submerged beneath the water line 80 and the protruding body segment 4 emerging from the water body 78 beyond the surface of the water line 80. The tagline 70 extends linearly from the buoy body 2, typically above and nearly parallel to the submersible body segment 3 in the direction of current 84 (FIG. 9) in the water body 78.

As illustrated in FIG. 9, under circumstances in which the current 84 in the water body 78 is swift (such as exceeding 4.5 mph, for example), the hydrodynamic lift 86 of the submersible body segment 3 resists the current 84 such that the angular orientation of the protruding body segment 4 relative to the water line 80 is minimized, preventing the protruding body segment 4 from being submerged in the water body 78 under the swift current 84. Therefore, the protruding body segment 4 remains highly visible to the operators of marine vehicles which navigate on the water body 78. The buoy rudder 48 maintains stability and ballast when the buoy body 2 is deployed in the upright position in the water body 78. The buoy rudder 48 may additionally serve to destabilize the buoy body 2 when drift catches on the buoy body 2, placing additional drag on the connecting portion 5 and protruding body segment 4. This action may cause the buoy body 2 to lean downstream and push the buoy rudder 48 forward into the current 84. Thus, the buoy body 2 may yaw side to side, clearing the drift before re-stabilizing upright on the surface of the water body 78. The tapered side connecting portion walls 16 on the connecting portion 5 of the buoy body 2 may decrease resistance of the buoy body 2 to the current 84 by reducing the frontal area (not illustrated) of the submersible portion of the buoy body 2.

It will be appreciated by those skilled in the art that the radar reflective plates 29 of the radar reflector assembly 24 may be oriented at about 45 degrees relative to the deployed attitude of the buoy body 2 in the water body 78. The positions of the radar reflective plates 29 and the presence of the assembly ring support frame 28 provide a large surface area for reflection of radar waves to an approaching vessel even in the event that the buoy body 2 is leaning substantially toward or away from the vessel. The assembly ring 27 and the frame notches 30 in the assembly ring support frame 28 may facilitate deployment and retrieval of the hydroplaning navigation buoy 1 in the water body 78, facilitate handling of the hydroplaning navigation buoy 1 on deck, help prevent barge and vessel damage due to sharp edges and prevent damage to the radar reflective plates 29.

Figure 10:
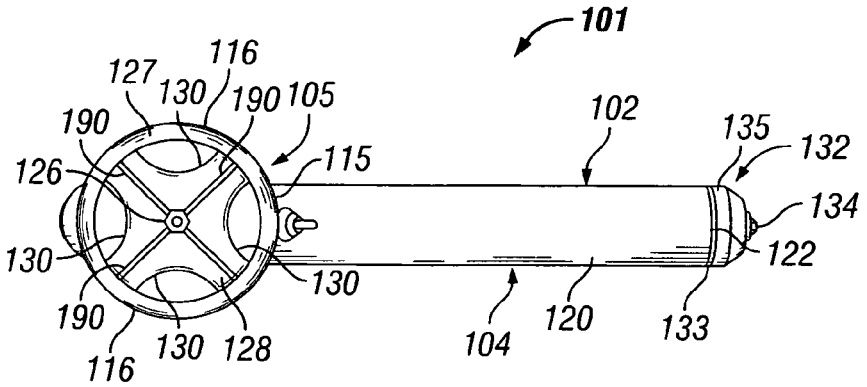
FIG. 10 is a top view of an alternative illustrative embodiment of the hydroplaning navigation buoy fitted with multiple nun plates.
Figure 11:
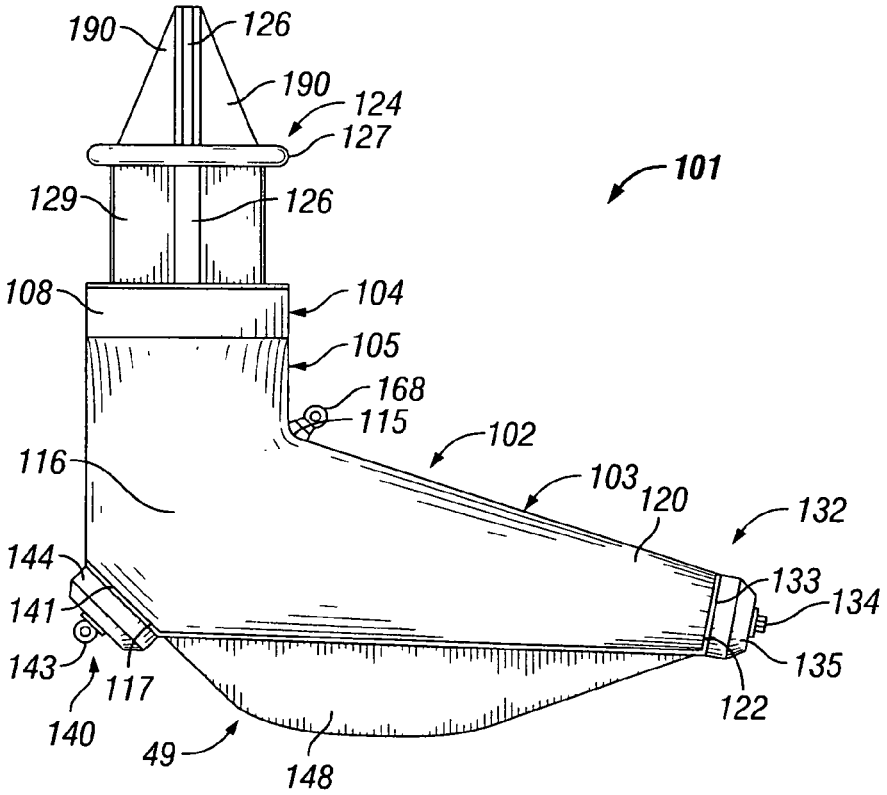
FIG. 11 is a side view of the illustrative hydroplaning navigation buoy illustrated in FIG. 10.

Referring next to FIGS. 10 and 11 of the drawings, an alternative illustrative embodiment of the hydroplaning navigation buoys is generally indicated by reference numeral 101. In the hydroplaning navigation buoy 101 illustrated in FIGS. 10 and 11, components which are analogous to the respective components of the hydroplaning navigation buoy 1 which was heretofore described with respect to FIGS. 1-9 are indicated by reference numerals 101-199 in FIGS. 10 and 11. Accordingly, the assembly tube 126 may extend upwardly beyond the assembly ring 127 of the radar reflector assembly 124. Multiple nun plates 190 may be welded or otherwise attached to the assembly ring support frame 128 and the assembly tube 126. In some embodiments, each nun plate 190 may be generally triangular and may be disposed at about 90 degrees with respect to each other and at about a 45-degree angle with respect to the vertical centerline of the deployed attitude of the buoy body 102.

Figure 12:
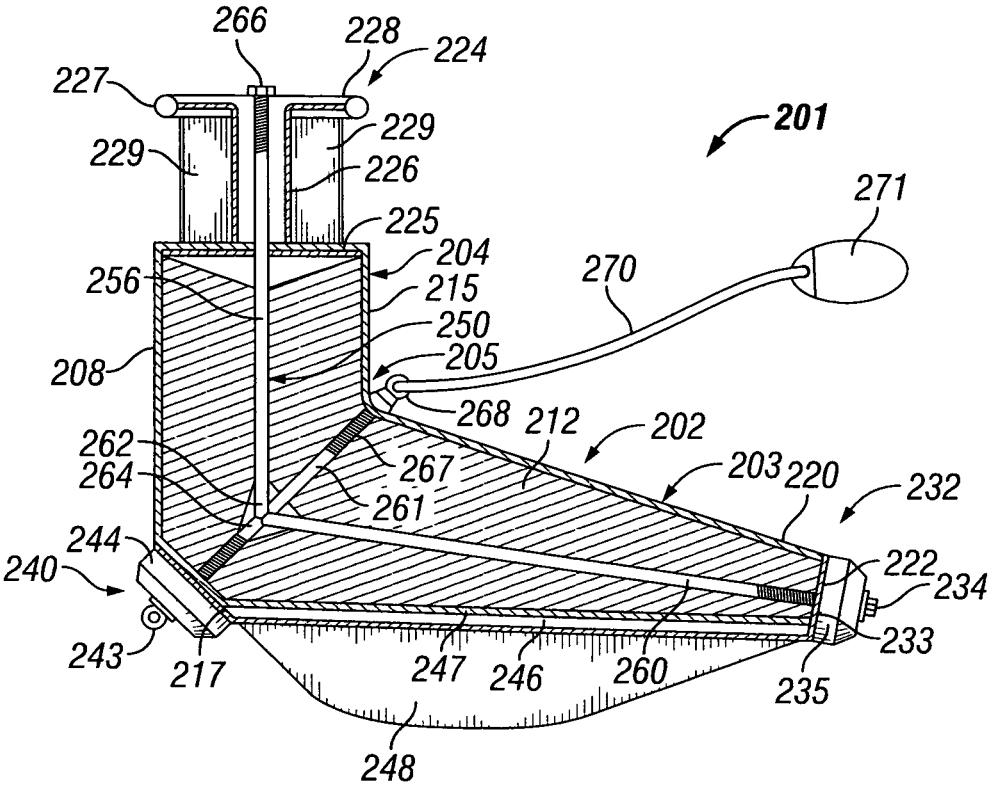
FIG. 12 is a longitudinal sectional view of another alternative illustrative embodiment of the hydroplaning navigation buoy with an alternative buoy frame configuration.
Figure 13:
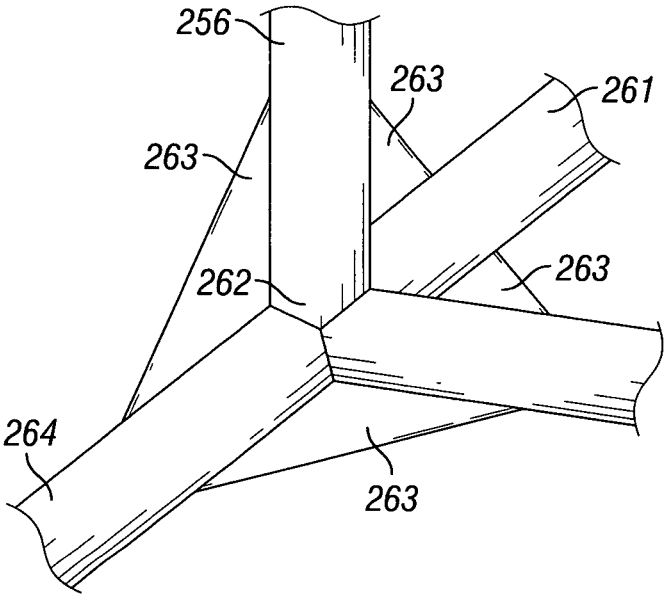
FIG. 13 is an enlarged sectional view of a portion of a buoy frame according to the illustrative hydroplaning navigation buoy illustrated in FIG. 12.

Referring next to FIGS. 12 and 13 of the drawings, another alternative illustrative embodiment of the hydroplaning navigation buoys is generally indicated by reference numeral 201. In the hydroplaning navigation buoy 201 illustrated in FIGS. 12 and 13, components which are analogous to the respective components of the hydroplaning navigation buoy 1 which was heretofore described with respect to FIGS. 1-9 are indicated by reference numerals 201-299 in FIGS. 12 and 13. Accordingly, a buoy frame 250 of the buoy body 202 may include a reflector assembly segment 256, a tagline segment 261, a rear ballast assembly segment 260 and a front ballast assembly segment 264 which may be joined to each other at a segment junction 262. Gussets 263 may be welded or otherwise provided between the adjacent segments of the buoy frame 250 for stability purposes. The outer ends of the reflector assembly segment 256, the tagline segment 261, the rear ballast assembly segment 260 and the front ballast assembly segment 264 may be internally threaded for threadable engagement of the respective reflector assembly retaining bolt 266, the tagline bolt 268, the rear ballast weight bolt 234 and the front ballast weight bolt 243.

While the embodiments of the disclosure have been described above, it will be recognized and understood that various modifications can be made and the appended claims are intended to cover all such modifications which may fall within the spirit and scope of the disclosure.

What is claimed is:

1. A hydroplaning navigation buoy, comprising:

a buoyant buoy body including:

an elongated water submersible body segment;

a buoy rudder carried by the water submersible body segment;

a protruding body segment extending from the water submersible body segment in angular relationship thereto; and a radar reflector assembly carried by the protruding body segment, the radar reflector assembly including an assembly base plate, at least one reflector indexing brace extending downward from the assembly base plate and an assembly tube extending downward through and upward-standing from a central portion of the assembly base plate, a plurality of radar reflective plates extending outwardly from the assembly tube, and an assembly ring support frame and an assembly ring carried by the radar reflective plates.

2. The hydroplaning navigation buoy of claim 1 further comprising at least one ballast assembly carried by the buoy body.

3. The hydroplaning navigation buoy of claim 2 wherein the at least one ballast assembly comprises at least one ballast weight.

4. The hydroplaning navigation buoy of claim 1 further comprising a tagline attached to the buoy body and a tagline buoy attached to the tagline.

5. The hydroplaning navigation buoy of claim 1 further comprising a buoyant material in the buoy body.

6. The hydroplaning navigation buoy of claim 1 further comprising a frame hub in the buoy body.

7. A hydroplaning navigation buoy, comprising:

a buoyant buoy body including:

an elongated water submersible body segment;

a buoy rudder carried by the water submersible body segment;

a generally cylindrical protruding body segment extending from the water submersible body segment in angular relationship thereto; and a curved connecting portion connecting the submersible body segment and the protruding body segment, the curved connecting portion having a pair of inwardly tapered side connecting portion walls extending from the protruding body segment to the water submersible body segment.

8. The hydroplaning navigation buoy of claim 7 further comprising a radar reflector assembly carried by the protruding body segment.

9. The hydroplaning navigation buoy of claim 8 wherein the radar reflector assembly comprises an assembly base plate, at least one reflector indexing brace extending downward from the assembly base plate and an assembly tube extending downward through and upward-standing from the assembly base plate, a plurality of radar reflective plates extending outwardly from the assembly tube, and an assembly ring support frame and an assembly ring carried by the radar reflective plates.

10. The hydroplaning navigation buoy of claim 9 further comprising a plurality of nun plates carried by the assembly ring support frame of the radar reflector assembly.

11. The hydroplaning navigation buoy of claim 7 further comprising a first ballast assembly carried by the water submersible body segment and a second ballast assembly carried by the connecting portion of the buoy body.

12. The hydroplaning navigation buoy of claim 7 further comprising a tagline attached to the buoy body and a tagline buoy attached to the tagline.

13. The hydroplaning navigation buoy of claim 7 further comprising a buoyant material in the buoy body.

14. The hydroplaning navigation buoy of claim 7 further comprising a frame hub in the buoy body.

15. A hydroplaning navigation buoy, comprising:

a buoyant buoy body including:

an elongated water submersible body segment;

a buoy rudder assembly carried by the water submersible body segment, the buoy rudder assembly having:

a rudder indexing brace;

a buoy rudder carried by the rudder indexing brace;

a rear ballast base plate engaging the rudder indexing brace; and a front ballast base plate engaging the rudder indexing brace;

a generally cylindrical protruding body segment extending from the water submersible body segment in angular relationship thereto; and a curved connecting portion connecting the submersible body segment and the protruding body segment, the curved connecting portion having a pair of inwardly tapered side connecting portion walls extending from the protruding body segment to the water submersible body segment;

a tagline connector hook carried by the buoy body;

a radar reflector assembly carried by the protruding body segment of the buoy body;

a first ballast assembly carried by the water submersible body segment of the buoy body;

a second ballast assembly carried by the curved connecting portion of the buoy body; and a frame hub inside the buoy body, the frame hub connected to the radar reflector assembly, the tagline connector hook, the first ballast assembly and the second ballast assembly.

16. The hydroplaning navigation buoy of claim 15 wherein the radar reflector assembly comprises an assembly base plate, at least one reflector indexing brace extending downward from the assembly base plate and an assembly tube extending downward through and upward-standing from the assembly base plate, a plurality of radar reflective plates extending outwardly from the assembly tube, and an assembly ring support frame and an assembly ring carried by the radar reflective plates.

17. The hydroplaning navigation buoy of claim 16 further comprising a plurality of nun plates carried by the assembly ring support frame of the radar reflector assembly.

18. The hydroplaning navigation buoy of claim 15 further comprising an anchor attachment hook carried by the second ballast assembly.

19. The hydroplaning navigation buoy of claim 15 further comprising a reflector assembly retaining bolt retaining the radar reflector assembly on the protruding body segment and engaging the frame hub, a tagline bolt retaining the tagline connector hook on the buoy body and engaging the frame hub, a first ballast weight bolt retaining the first ballast assembly on the water submersible body segment of the buoy body and engaging the frame hub and a second ballast weight bolt retaining the second ballast assembly on the water submersible body segment of the buoy body and engaging the frame hub.

* * * * *